US007247329B2

(12) United States Patent
Mattisson

(10) Patent No.: US 7,247,329 B2
(45) Date of Patent: Jul. 24, 2007

(54) DOUBLE SEALED PIZZA PACKAGE AND METHOD OF MAKING

(75) Inventor: Lennart Mattisson, W. Redding, CT (US)

(73) Assignee: Kraft Foods Holdings, Inc., Northfield, IL (US)

( * ) Notice: Subject to any disclaimer, the term of this patent is extended or adjusted under 35 U.S.C. 154(b) by 418 days.

(21) Appl. No.: 10/356,282

(22) Filed: Jan. 31, 2003

(65) Prior Publication Data

US 2004/0151811 A1 Aug. 5, 2004

(51) Int. Cl.
*B65D 3/26* (2006.01)
*B65D 65/26* (2006.01)

(52) U.S. Cl. ..... 426/108; 206/471; 206/484; 383/210; 383/211; 426/128

(58) Field of Classification Search ..... 426/128, 426/129, 130, 108; 383/210, 211; 206/484, 206/471

See application file for complete search history.

(56) References Cited

U.S. PATENT DOCUMENTS 1,413,064 A * 4/1922 Salfisberg ..... 206/538
3,392,033 A 7/1968 Thulin
3,604,616 A 9/1971 Greif
3,637,132 A 1/1972 Gray
3,648,428 A 3/1972 Colburn
3,854,653 A 12/1974 Engelsberger
3,861,529 A 1/1975 Coleman
3,861,576 A 1/1975 Tolaas et al.

(Continued)

FOREIGN PATENT DOCUMENTS

EP 0470771 2/1992

(Continued)

OTHER PUBLICATIONS

Food Packaging Technology vol. 1, VCH Publishers, Inc. 1996, p. 226-227.*

*Primary Examiner*—Arthur L. Corbin
(74) *Attorney, Agent, or Firm*—Fitch, Even, Tabin & Flannery

(57) ABSTRACT

A hermetic package for a food product having a first wall, a second wall and a receiving cavity. The first wall defines a first portion of the receiving cavity and a first flange surrounding the first portion of the receiving cavity. The second wall defines a second portion of the receiving cavity and a second flange surrounding the second portion of the receiving cavity. The second flange is preferably configured so that it is generally consistent with the configuration of the first flange. The first portion of the receiving cavity and the second portion of the receiving cavity are combined to form the receiving cavity by joining the first flange of the first wall to the second flange of the second wall to form an inner seal that is disposed outside of and surrounds the receiving cavity. The first flange of the first wall and the second flange of the second wall are further joined to one another to form an outer seal that is disposed outside of and at least partially surrounds the inner seal and the receiving cavity. The inner seal and the outer seal are configured so that they are substantially separated from one another by one or more gaps where the first flange is not joined to the second flange.

9 Claims, 3 Drawing Sheets

U.S. PATENT DOCUMENTS

| | | | | |
|---|---|---|---|---|
| D250,249 | S | | 11/1978 | Flecken |
| D251,895 | S | | 5/1979 | Belmuth et al. |
| 4,196,809 | A | | 4/1980 | Tonrey |
| 4,361,227 | A | | 11/1982 | Paulucci |
| 4,410,089 | A | | 10/1983 | Bortolani |
| 4,611,456 | A | | 9/1986 | Gillio-tos et al. |
| 4,656,068 | A | | 4/1987 | Raines |
| 4,815,602 | A | | 3/1989 | Schirmer |
| 4,834,247 | A | | 5/1989 | Oshima et al. |
| 4,834,427 | A | | 5/1989 | Takada |
| 4,881,359 | A | | 11/1989 | Schirmer |
| 4,890,744 | A | | 1/1990 | Lane, Jr. et al. |
| 4,891,482 | A | | 1/1990 | Jaeger et al. |
| 4,940,867 | A | | 7/1990 | Peleg |
| D311,488 | S | | 10/1990 | Regenscheid |
| 5,167,974 | A | * | 12/1992 | Grindrod et al. ..... 426/127 |
| 5,246,720 | A | * | 9/1993 | Buchko ..... 426/106 |
| 5,247,149 | A | | 9/1993 | Peleg |
| 5,839,832 | A | | 11/1998 | Hagino |
| 5,894,929 | A | | 4/1999 | Kai et al. |
| D425,416 | S | | 5/2000 | Denham et al. |
| D426,152 | S | | 6/2000 | Denham et al. |
| 6,168,812 | B1 | | 1/2001 | Paulucci |
| 6,244,746 | B1 | | 6/2001 | Tokita et al. |
| 6,325,542 | B1 | | 12/2001 | Komatsu |

FOREIGN PATENT DOCUMENTS

| | | |
|---|---|---|
| GB | 2049604 | 12/1980 |
| JP | 4-201882 | 7/1992 |

* cited by examiner

FIG. 1
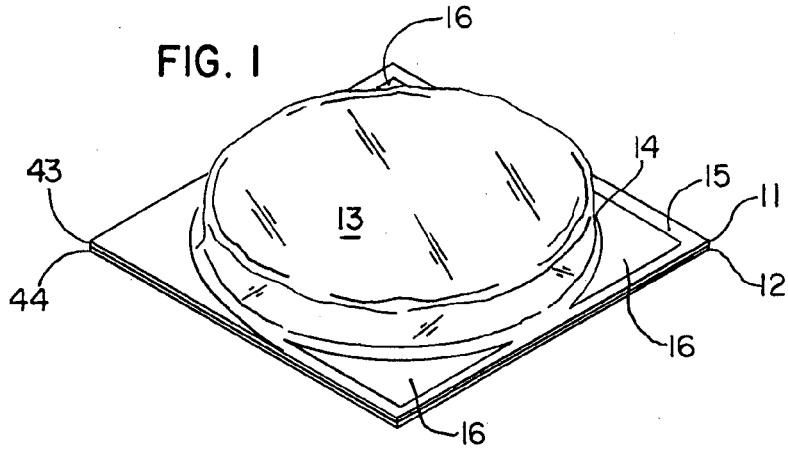
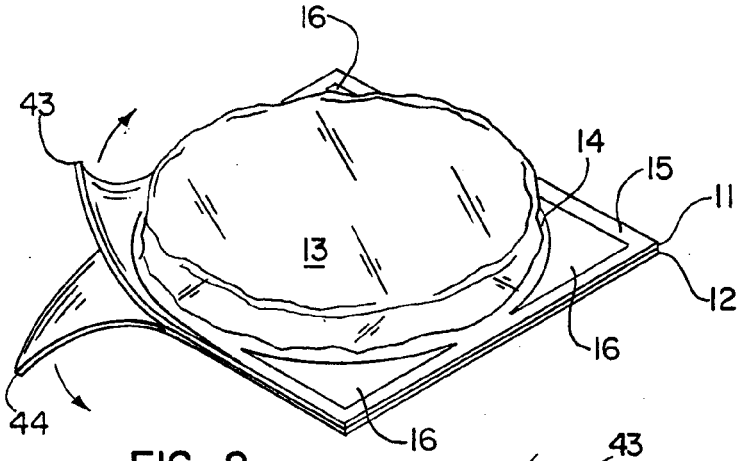
FIG. 2
FIG. 3
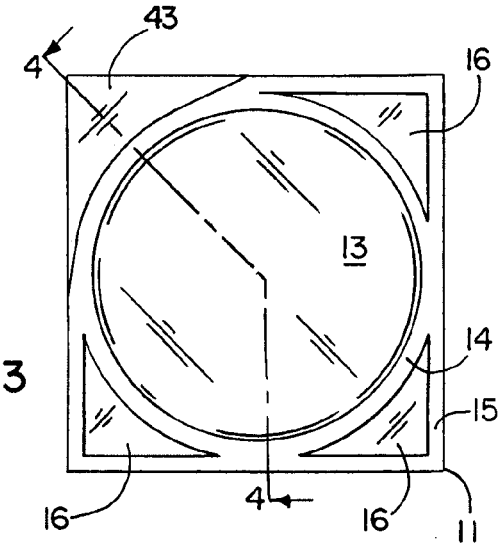

DOUBLE SEALED PIZZA PACKAGE AND METHOD OF MAKING

FIELD OF THE INVENTION

The present invention relates generally to packaging for food products, and more particularly to hermetic packaging for food products.

BACKGROUND OF THE INVENTION

In packaging a food product for distribution and sale to consumers, manufacturers must consider, among other issues, the cost and degree of difficulty of manufacturing a package, the ability of a package to resist damage, leakage and spillage during any further manufacturing operations as well as during subsequent shipping, retailing and post-purchase activities, the appearance of the packaged product, and the degree of difficulty associated with removing the product from a package.

For certain types of food products, manufacturers must also consider the ability of a package to prevent certain gasses or vapors from leaking into or out of the packaged product between packaging and consumption by consumers. Packages for products such as ready-to-bake breads, and products incorporating ready-to-bake breads such as frozen pizza products and the like, must be generally impermeable to certain gasses and vapors and well sealed so that functional properties that affect the performance of the product may be preserved at levels acceptable to consumers. In the case of frozen pizza products, packages must prevent the infiltration of undesirable amounts of oxygen, which can impair the ability of the pizza crust to rise during preparation and baking, and the exfiltration of undesirable amounts of water vapor during cold storage, which can cause "freezer burn", both of which tend to degrade the baking performance of the product and give rise to an underdeveloped crust that is of poor quality.

Although the prior art discloses various gas resistant, gas impermeable and hermetic packages for food products (herein such packages will be defined generically as hermetic packages for simplicity), there is a continuing need to reduce package failure rates and thereby the number of defective units of packaged product as well as program costs associated with manufacturers' efforts to assure consumer satisfaction and goodwill. In the case of frozen pizza products, packaging defects such as incomplete seals, weakly bonded portions of seals and portions of seals bridged by small food items can compromise package integrity and degrade baking performance. Such defects may not become apparent to consumers during casual inspection prior to baking, foreclosing opportunities to reject defectively packaged products prior to purchase, or to return defectively packaged products in a condition suitable for exchange. Such defects may instead only evince themselves through poor baking performance, which may lead consumers to believe that a product itself, rather than a defectively packaged unit of product, is of poor quality and substantially reduce the likelihood of repeat sales.

Package designs for these types of food products should not unnecessarily increase the degree of difficulty associated with removing a product from a package. In convenience food products, including frozen pizza products and the like, packages that do not require consumers to use scissors, a knife or some other sharp implement to access the food product can significantly contribute to consumer satisfaction with the overall product. If a product is to be packaged in a tool-less package that incorporates a peelable seal, manufacturers must consider a trade off between the width and strength of the peelable seal, where increased width and strength tends to contribute to decreased package failure rates, and the degree of difficulty associated with removing the product from the package, where the degree of difficulty tends to increase as the peeling force required to open the package increases in relation to the width and strength of the peelable seal.

SUMMARY OF THE INVENTION

The invention provides a novel and improved hermetic package for food products having a double seal to reduce the frequency of package failure caused by packaging defects. The double seal reduces the likelihood that a packaging defect such as an incomplete seal, a weakly bonded portion of a seal or a portion of a seal bridged by small food items will give rise to a channel connecting the interior of a package to the external environment. The double seal may also substantially reduce the peeling force required to open a package incorporating peelable seals in comparison to that required to open a package incorporating a single peelable seal of comparable dimensions. The invention also provides a novel and improved method and apparatus for forming, filling and sealing such packages in high speed commercial packaging operations.

In accordance with the invention, there is provided a hermetic package for a food product having a first wall, a second wall and a receiving cavity. The first wall defines a first portion of the receiving cavity and a first flange surrounding the first portion of the receiving cavity, and is preferably formed from a single sheet of thin, flexible material which may comprise a single or multiple layers. The second wall defines a second portion of the receiving cavity and a second flange surrounding the second portion of the receiving cavity, and is also preferably formed from a single sheet of thin, flexible material, which may also comprise a single or multiple layers. The second flange is preferably configured so that it is generally consistent with the configuration of the first flange. The first portion of the receiving cavity and the second portion of the receiving cavity are combined to form the receiving cavity by joining the first flange of the first wall to the second flange of the second wall to form an inner seal that is disposed outside of and surrounds the receiving cavity. The first flange of the first wall and the second flange of the second wall are further joined to one another to form an outer seal that is disposed outside of and at least partially surrounds the inner seal and the receiving cavity. The outer seal preferably substantially surrounds the inner seal and the receiving cavity, and may also fully surround the inner seal and the receiving cavity.

The inner seal and the outer seal are configured so that they are substantially separated from one another by one or more gaps where the first flange is not joined to the second flange. The inner seal, gap and outer seal in combination form a composite seal that may be configured to extend across a design width that is likely to exceed the size of any small defects arising on a packaging line over at least part of the seal area. Alternatively, if a food product is packaged using web-based, roll stock materials or other materials that must be trimmed to shape, the outer seal may be configured to extend about the periphery of the package to form a composite seal that incorporates material which might otherwise be trimmed and discarded as scrap, reducing package failure rates and minimizing incremental costs. The outer seal may then be configured so that it partially intersects or becomes coincident with the inner seal at selected locations such as tangent areas to minimize packaging material requirements and/or maximize the dimensions of the receiving cavity.

If a package incorporates peelable seals, the inner seal, gap and outer seal in combination may form a composite seal that requires less peeling force to separate than a single seal extending across the same width. The difference in peeling force will be dependent upon the relative widths of the inner seal, gap and outer seal. If an outer seal is configured to extend about the periphery of such a package, it may be desirable to omit a portion of the outer seal between opposing portions of the first flange and the second flange to provide a tab portion that may be pulled apart to separate the first package piece from the second package piece and provide access to the receiving cavity.

BRIEF DESCRIPTION OF THE DRAWINGS

FIG. 1 is a perspective view of the a first embodiment of the invention.

FIG. 2 is a perspective view of the embodiment of FIG. 1 with the tab portion elements separated.

FIG. 3 is a plan view of the embodiment of FIG. 1.

DETAILED DESCRIPTION OF PREFERRED EMBODIMENTS

Figure 4:
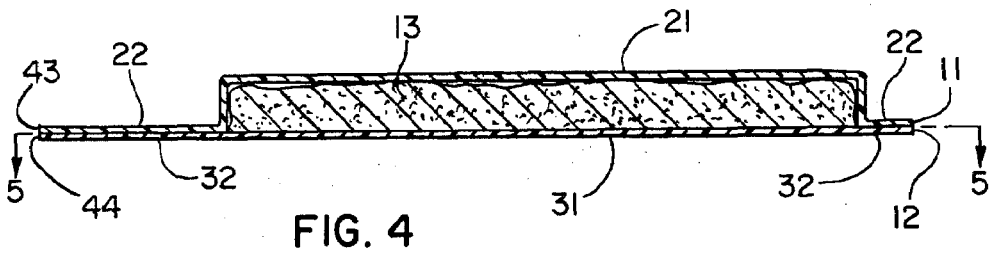
FIG. 4 is a sectional view of the embodiment of FIG. 1 taken along the line 4–4' of FIG. 3.

Referring to FIGS. 1–5, there is shown an embodiment of a package for food products. The package has a first wall 11 and a second wall 12, both of which are preferably formed from sheets of thin, flexible material. Such material may be constructed from a variety of thermoplastic polymers, laminates of thermoplastic polymers and laminates of thermoplastic polymers and foils. In other embodiments, the first wall 11 may be formed from a sheet of thin, flexible material to form a top web, and the second wall 12 formed from thicker and/or semi-rigid variations of the materials discussed above as well as laminates incorporating paperboard to form a tray or receiving body. The first wall 11 and the second wall 12 define a receiving cavity 13, as discussed below.

The first wall 11 defines a first portion 21 of the receiving cavity 13 and a first flange 22. The first portion 21 is configured to cover or partially enclose the food product to be packaged in the receiving cavity 13. In the preferred embodiment, the first wall 11 is thermoformed so that the first portion 21 is configured as a circular well, but the first wall 11 may also be thermoformed, stamped or otherwise shaped into any configuration consistent with the shape of the food product to be packaged. The first flange 22 surrounds the first portion 21 and is preferably configured as a planar surface. In the preferred embodiment, the first flange 22 is configured to be rectangular or square, but the first flange 22 may also be configured to provide any other geometric or irregular margin that may be desired. Considerations such as the appearance of the packaged product may make it desirable to provide a non-circular margin so that the package may be further packaged with a definite orientation and integrated with other materials and/or indicia.

The second wall 12 defines a second portion 31 of the receiving cavity 13 and a second flange 32. In the preferred embodiment, the second portion 31 comprises a central portion of the second wall 12 adjacent to the receiving cavity 13. However, the second portion 31 may also be configured to partially enclose the food product to be packaged in the receiving cavity 13. In other embodiments, the second wall 12 may be thermoformed, stamped or otherwise shaped into any configuration consistent with the shape of the food product to be packaged. The second flange 32 surrounds the second portion 31 and is preferably configured so that it is generally consistent with the configuration of the first flange 22.

Figure 5:
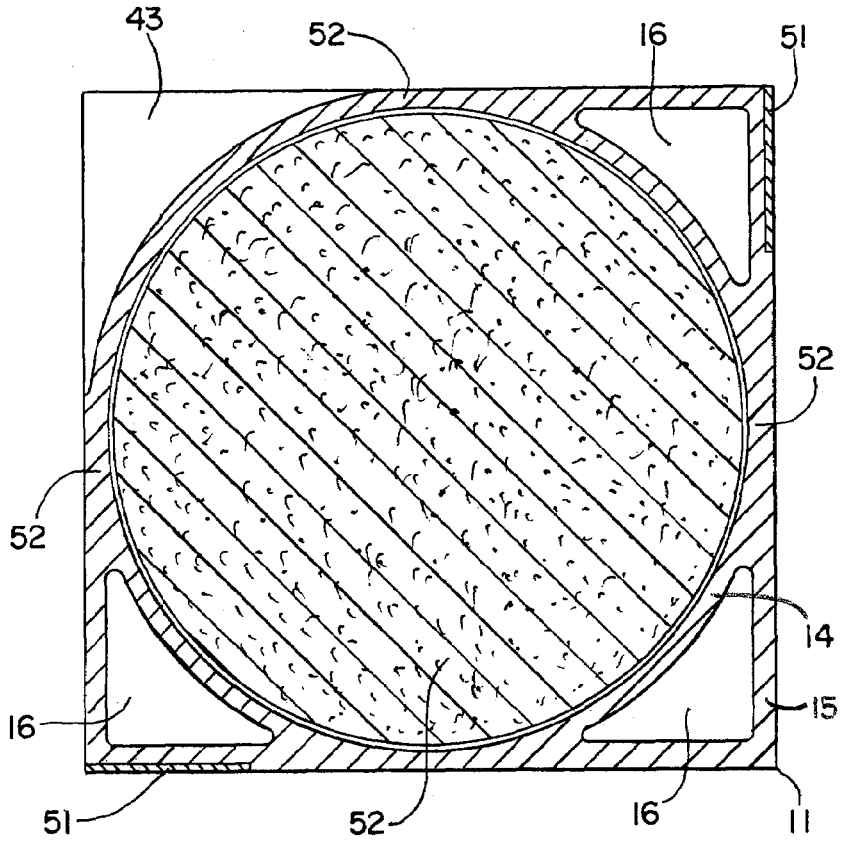
FIG. 5 is a sectional view of the embodiment of FIG. 1 taken along the line 5–5' of FIG. 4.
Figure 7:
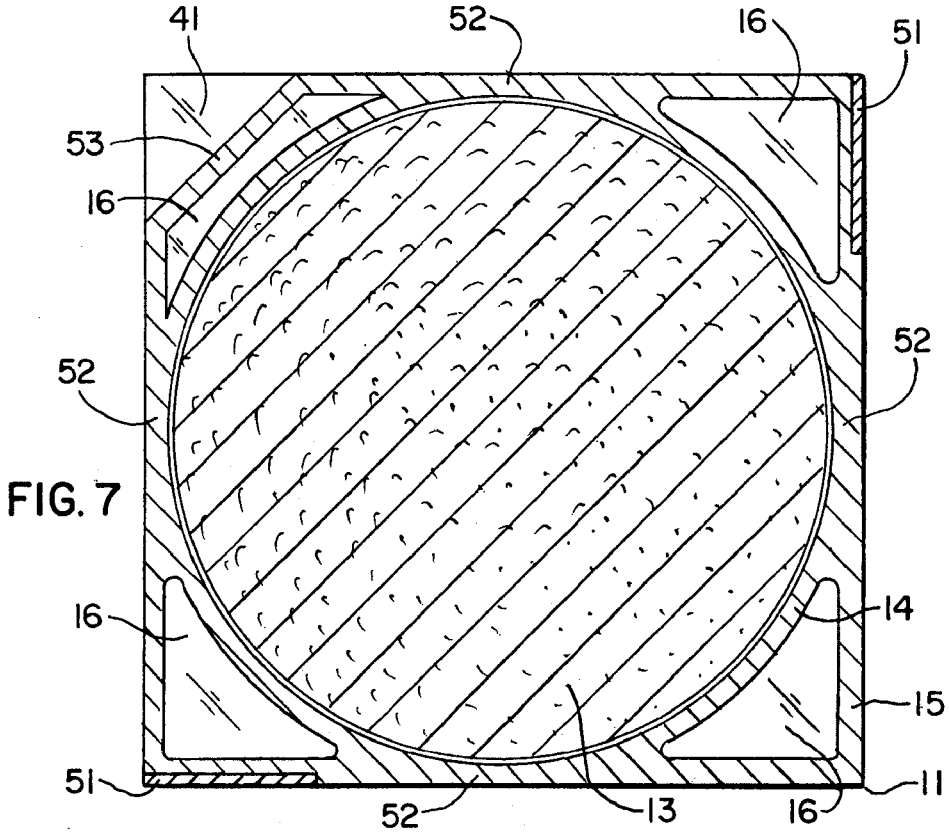
FIG. 7 is a sectional view similar to that shown in FIG. 5 of a second embodiment of the invention.

The first wall 11 and the second wall 12 are joined at the first flange 22 and the second flange 32 by an inner seal 14 and an outer seal 15 to enclose a food product within the receiving cavity 13. The inner seal 14 is disposed outside of and surrounds the receiving cavity 13. The outer seal 15 is disposed outside of and at least partially surrounds the inner seal 14 and the receiving cavity 13. The inner seal 14 and the outer seal 15 are configured so that they are substantially separated from one another by one or more gaps 16 where the first flange 22 is not joined to the second flange 32 by a seal. The inner seal 14, gap 16 and outer seal 15 may be configured so that the collective width is likely to exceed the size of many small defects arising during packaging, thereby reducing the likelihood that a packaging defect will create a channel extending from the receiving cavity 13 and through the inner seal 14, gap 16 and outer seal 15 to connect the interior of the package to the external environment. Alternatively, as in the preferred embodiment, the outer seal 15 may be configured to extend about the periphery of the package to incorporate material which might otherwise be trimmed and discarded as scrap, reducing package failure rates but minimizing incremental costs since no additional packaging material is required to manufacture the package. The outer seal 15 may then be configured so that it partially intercepts or becomes coincident with the inner seal 14 at locations such as tangent points 52 to minimize packaging material requirements and/or maximize the dimensions of the receiving cavity 13. As shown in FIG. 5, the outer seal 15 preferably substantially surrounds the inner seal 14 and the receiving cavity 13. Alternatively, the outer seal 15 may fully surround the inner seal 14 and the receiving cavity 13, and as shown in FIG. 7, may also include a seal portion 53 spaced inward from the periphery of the package to provide an unsealed tab portion 17, discussed below.

Figure 6:
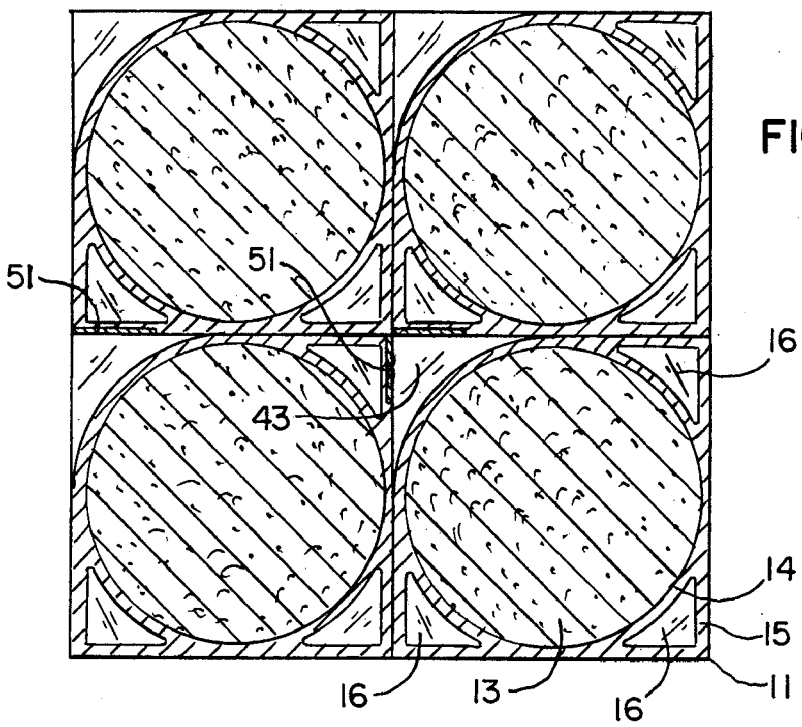
FIG. 6 is a sectional view similar to that shown in FIG. 5, illustrating a plurality of packages being formed simultaneously.

As illustrated in FIG. 6, the outer seal 15 and gaps 16 may be configured so that a substantial amount of packaging material surrounding the inner seal 14 and receiving cavity 13 is incorporated into the double seal without altering the dimensions of the receiving cavity 13 or the dimensions of the stock material and packaging equipment used to manufacture the package. If the packaging equipment is capable of forming a plurality of packages simultaneously, it may be desirable to include one or more voids 51 where the first flange 22 is not joined to the second flange 32 by a seal in portions of the outer seal 15 adjacent to any tab portion 17 to reduce the likelihood that automated cutting machinery will produce packages with a tab portion that is partially sealed. In the preferred embodiment, voids 51 of about 1 millimeter in width have been found to be sufficient to address this consideration.

The inner seal 14 and the outer seal 15 may be formed via a variety of sealing techniques that are appropriate for use in packaging for food products and known to those skilled in the art. In the preferred embodiment, the inner seal 14 and the outer seal 15 are formed simultaneously by applying heat and pressure to the first flange 22 and the second flange 32 through the use of a heated die to fuse portions of the inner surface of the first flange 22 to portions of the inner surface of the second flange 32. However, the inner seal 14 and the outer seal 15 may also be formed separately. The inner seal 14 and the outer seal 15 may be formed as permanent seals to provide a durable package if a packaged food product is likely to be subjected to demanding conditions such as air cargo transport where a package would be subjected to significantly reduced external atmospheric pressures, or as peelable seals to provide a packaged food product that does not require consumers to use scissors, a knife or some other sharp implement to access the product. In the preferred embodiment, the inner seal 14 and the outer seal 15 are formed as peelable seals through the use of a laminate material in the first package piece 11 and the second package piece 12. This laminate material comprises an outer layer of biaxially oriented polyamide polymer, a central layer of polyethylene polymer and an inner layer of peelable food grade polymer, which may include polymers sold under the trademark "Surlyn" by E.I. duPont DeNemours & Co. of Wilmington, Del. Such a laminate is sold under the trademark "Curlam" by Curwood, Inc. of New London, Wis. In the preferred embodiment, the inner layer of peelable food grade polymer is fused to form seals with a typical width of about 7.5 millimeters, but alternate widths may be used depending upon the desired ability of the package to resist damage, leakage and spillage and the desired degree of difficulty associated with removing the product from the package. In other embodiments alternate materials and constructions using polymers, adhesives and/or thermal fusion techniques may be used to provide peelable seals. The inner seal 14 and the outer seal 15 may thereby be separated through the application of a peeling force to the first flange 22 and the second flange 32.

If the inner seal 14 and the outer seal 15 are formed as peelable seals, it may be desirable to provide a tab portion 17 so that consumers can readily apply a peeling force to the first flange 22 and the second flange 32 to separate the inner seal 14 and the outer seal 15. The tab portion 17 may be provided by configuring a portion of the first flange 22 to extend beyond the perimeter of the second flange 32 so that consumers can readily grip a portion of the first wall 11. Alternatively, as shown in FIG. 7, the tab portion 17 may be provided by configuring the first flange 22 to include a first tab portion 41 extending beyond the outer seal 15 and configuring the second flange 32 to include generally consistent second tab portion 42 also extending beyond the outer seal 15, so that consumers can separate the tab portion 17 to readily grip the first package piece 11 and the second package piece 12. Also alternatively, as shown in the preferred embodiment of FIGS. 1–6, the tab portion 17 may be provided by omitting a portion of the outer seal 15 to form a first tab portion 43 of the first flange 22 extending beyond the inner seal 14 and a generally consistent second tab portion 44 of the second flange 32 also extending beyond the inner seal 15, so that consumers can separate the tab portion 17 to readily grip the first package piece 11 and the second package piece 12. The package may include an arrow or other indicia to indicate the location of the tab potion 17.

Depending upon product requirements, the receiving cavity 13 may be formed under standard atmospheric conditions, reduced atmospheric pressure conditions to form a vacuum package or gas-flushed or modified-atmosphere conditions to form a modified atmosphere package. Packaging under standard atmospheric conditions may be desirable if the product can be preserved by merely isolating it from the external environment. Alternatively, vacuum packaging or modified atmosphere packaging may be desirable if a particular atmosphere, or lack thereof, is desired to inhibit microbial growth and/or preserve functional properties that affect the performance of the product at levels acceptable to consumers. The modified atmospheres used in such packaging may include inert gasses such as carbon dioxide, nitrogen and/or argon as well as sterilizing gasses such as ethylene oxide.

While a specific embodiment of the present invention has been shown and described, it will be apparent to those skilled in the art that the disclosed invention may be modified in numerous ways to assume many embodiments other than the preferred forms specifically set out and described above. Accordingly, it is intended that the appended claims cover all forms that fall within the true spirit and scope of the invention.

What is claimed is:

1. A method of making a package for a food product comprising:

providing a first wall, wherein said first wall defines a first portion of a receiving cavity and a first flange;

providing a second wall, wherein said second wall defines a second portion of a receiving cavity and a second flange;

forming an inner seal disposed outside of and surrounding said receiving cavity, said inner seal joining said first flange to said second flange;

forming an outer seal disposed outside of and at least partially surrounding said inner seal, said outer seal further joining said first flange to said second flange;

wherein the first wall includes a tab portion extending beyond the inner seal and the outer seal such that the tab portion is not adhered to the second wall; and wherein the outer seal includes a void area distinct from the tab portion disposed along at least a portion of an outer edge of the outer seal, the first flange not adhered to the second flange in said void area.

2. A package for a food product comprising:

a first sheet defining a cavity portion and a flange portion surrounding said cavity portion;

a second sheet partially adhered to the flange portion of said first sheet;

a first peel seal contiguous with said cavity portion, said first peel seal adhering said second sheet to the flange portion of said first sheet;

a second peel seal spaced outwardly from said first peel seal, said second peel seal adhering said second sheet to the flange portion of said first sheet;

a tab portion of the first sheet, the tab portion extending beyond the first and the second peel seal such that the tab portion is not adhered to the second sheet; and a void area distinct from the tab portion disposed along at least a portion of an outer edge of the second peel seal, the flange portion not adhered to the second sheet in said void area.

3. The package of claim 2 in combination with a plurality of additional packages defined by said first sheet and said second sheet, the plurality of packages being separated during manufacturing thereof.

4. The package of claim 3 wherein said void area of one of the plurality of packages extends along the tab portion of another of the plurality of packages prior to separation.

5. The package of claim 2 wherein the second peel seal surrounds the first peel seal.

6. The package of claim 2 wherein the first peel seal partially intersects the second peel seal.

7. The package of claim 2, wherein the tab portion and the void area are on opposite portions of the package.

8. The package of claim 2, wherein the package includes a second void area disposed along at least a second portion of the outer edge of the second peel seal, the flange portion not adhered to the second sheet in said second void area.

9. The package of claim 2, further comprising a food product in the cavity portion.

* * * * *